US005127132A

United States Patent [19]

Karlin

[11] Patent Number: 5,127,132

[45] Date of Patent: Jul. 7, 1992

[54] HINGE MADE FROM IDENTICAL HINGE PLATES

[76] Inventor: James Karlin, 28 Clarkes Crossing, Fairport, N.Y. 14450

[21] Appl. No.: 733,893

[22] Filed: Jul. 22, 1991

[51] Int. Cl.[5] ..... E05D 7/10

[52] U.S. Cl. ..... 16/261; 16/265; 16/DIG. 13

[58] Field of Search ..... 16/265, 261, DIG. 13

[56] References Cited

U.S. PATENT DOCUMENTS

| | | | |
|---|---|---|---|
| 32,482 | 6/1861 | Lane | 16/265 |
| 3,205,007 | 9/1965 | Sommer | 16/265 |
| 3,295,713 | 1/1967 | Optner | 16/265 |

FOREIGN PATENT DOCUMENTS

| | | | |
|---|---|---|---|
| 638988 | 11/1963 | Belgium | 16/265 |
| 332638 | 5/1903 | France | 16/265 |
| 2300197 | 10/1976 | France | 16/DIG. 13 |

*Primary Examiner*—Robert L. Spruill
*Assistant Examiner*—Carmine Cuda
*Attorney, Agent, or Firm*—Shlesinger Fitzsimmons Shlesinger

[57] ABSTRACT

Each of two identical hinge plates has projecting from one longitudinal side edge thereof four, spaced, coaxially aligned barrels, two of which have therethrough coaxial bores, and each of the other two of which has a reduced-diameter cylindrical pin projecting from one end thereof. The four barrels of each plate are arranged so that the two barrels containing bores are consecutive or adjacent to each other, and the two barrels bearing the cylindrical pins are adjacent to each other. A hinge is assembled by inserting the pins of each hinge plate coaxially and rotatably into the barrel bores in the other plate. Thereafter a locking element may be inserted between a pair of adjacent barrels to prevent accidental disengagement of the cylindrical pins from the barrel bores.

11 Claims, 3 Drawing Sheets

FIG. 3
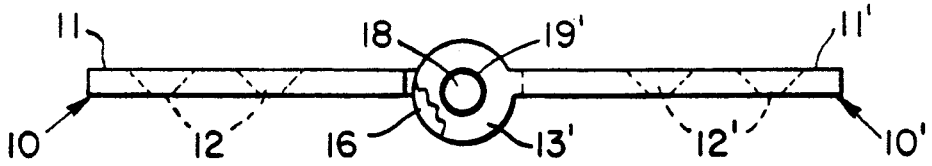
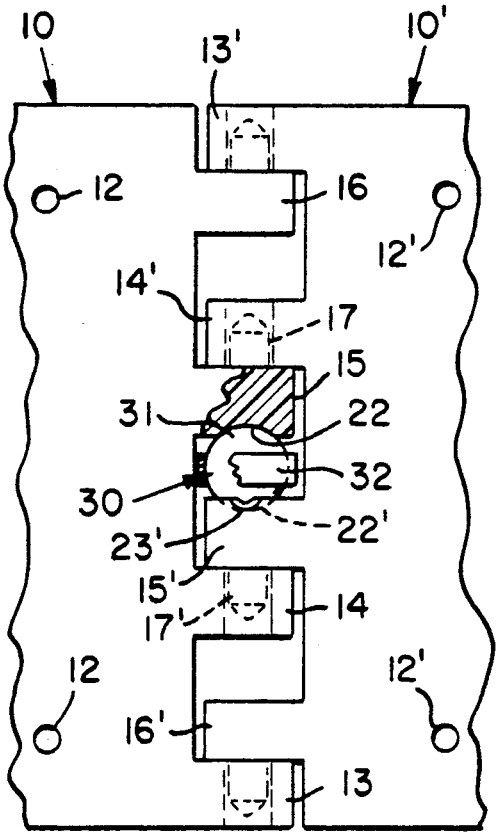
FIG. 4
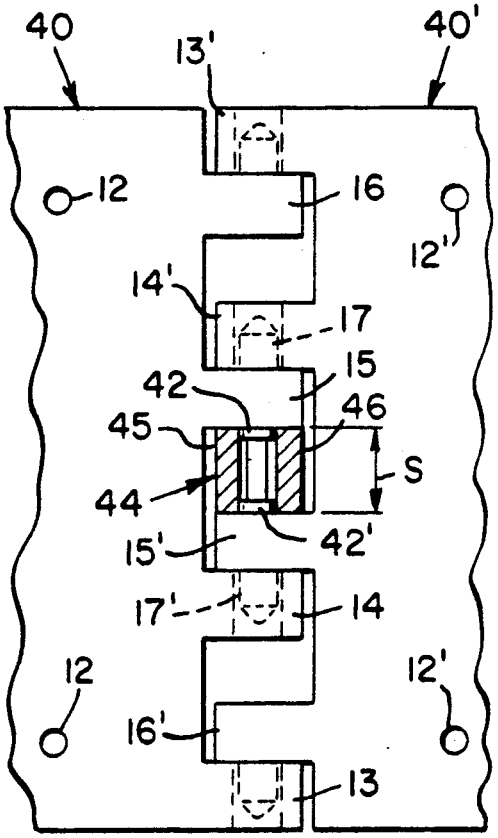
FIG. 5
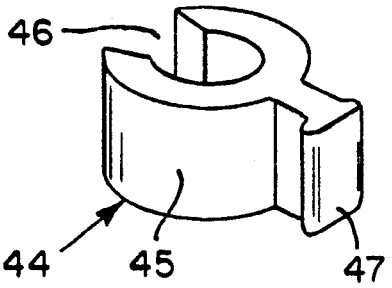
FIG. 5A
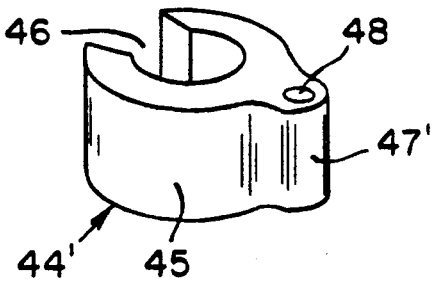
FIG. 5B

HINGE MADE FROM IDENTICAL HINGE PLATES

BACKGROUND OF THE INVENTION:

This invention relates to a hinge for an opening and closing apparatus, such as a door cover, or the like, and more particularly to novel hinge plates having thereon improved means for connecting the hinge plates together. Even more particularly this invention relates to a hinge which may be releasably secured in an operational position without the use of a conventional hinge pin.

A conventional hinge mounted on an opening and closing apparatus, such as a door, generally comprises two hinge plates, each having along one edge thereof spaced projections which are curled or rolled in a fashion so as to produce thereon annular barrels or knuckles. When the barrels of the two plates are positioned in alternating, registering relation, they form, collectively, a tubular shaft. Disposed inside the tubular shaft is a hinge pin that prevents mis-alignment of the barrels, and also pivotally connects together the two hinge plates. The cost of producing such a conventional hinge is relatively high because of the necessary multi-step production process, whereby the different but complimentary hinge plates are fabricated, their tabs are folded to create the tubular barrels, and then the complimentary plates are coupled with a hinge pin. The cost of production is further increased when larger hinges are produced because thicker hinge plates must be utilized and a longer frabrication time is therefore required. Also, certain of these conventional hinges are plagued by a tendency to rise up when the door, upon being swung about its hinge axis, encounters an elevated floor surface such as carpeting.

Hinges without a tubular shaft, such as the hinge described in U.S. Pat. No. 4,658,471, also suffer from increased production costs due to multi-step production processes. A hinged card file punch as shown in U.S. Pat. No. 4,869,143 utilizes a pair of hinge plates having thereon cooperating pins and barrels, but the plates are not identical, and instead require special lug and camming surfaces to effect assembly of the punch.

It is an object of this invention, therefore, to provide a novel hinge requiring only two identical hinge plates.

It is also an object of this invention to provide a low-cost method for producing the aforesaid hinge.

Another object of this invention is to provide several optional means for releasably securing together the two plates of a hinge in an operational position, and without using a conventional hinge pin.

Other objects of the invention will be apparent hereinafter from the specification and from the recital of the appended claims, particularly when read in conjunction with the accompanying drawings.

SUMMARY OF THE INVENTION

Each hinge consists of two identical plates each of which has a flattened section serving to bind the plate to, for example, a door frame or a door, and four, spaced, coaxially aligned extensions or barrels. Each of two of the barrels possesses a bore which extends coaxially through the associated barrel, and each of the other two barrels is solid and has thereon a reduced-diameter cylindrical projection which projects coaxially from the flat end surface of a respective barrel. The diameters of the barrel projections are slightly smaller than the diameters of the barrel bores; and both cylindrical projections on each plate point in the same axial direction. The four barrels of each plate are arranged so that the two barrels containing bores are consecutive or adjacent to each other, and the two barrels bearing the cylindrical projections are adjacent to each other. This arrangement guarantees that the barrel bearing the cylindrical projections will be the two uppermost or two lowermost barrels when used to construct a hinge.

Assembly of the hinge requires that the projections and bores of one hinge plate coaxially align with corresponding bores or projections of a second hinge plate. Each of the cylindrical projections then slide into a corresponding bore so as to be rotatable therein, and so that the flat surfaces of corresponding barrels on opposite plates are touching. This is the operational position of the hinge. Thereafter, is desired, a locking element may be inserted between a pair of adjacent barrels to prevent accidental disengagement of the cylindrical projections from the bores.

BRIEF DESCRIPTION OF THE DRAWINGS

FIG. 3 is a plan view of the hinge shown in FIG. 2;

FIG. 4 is a front elevational view of this hinge as it appears when finally assembled with a ball-color locking element engaged between two of its barrels;

FIG. 5 is a front elevational view of a modified hinge made according to a second embodiment of this invention;

FIGS. 5A and 5B are perspective views of two types of locking elements which can be employed with this second embodiment;

DETAILED DESCRIPTION OF THE PREFERRED EMBODIMENTS

Figure 1:
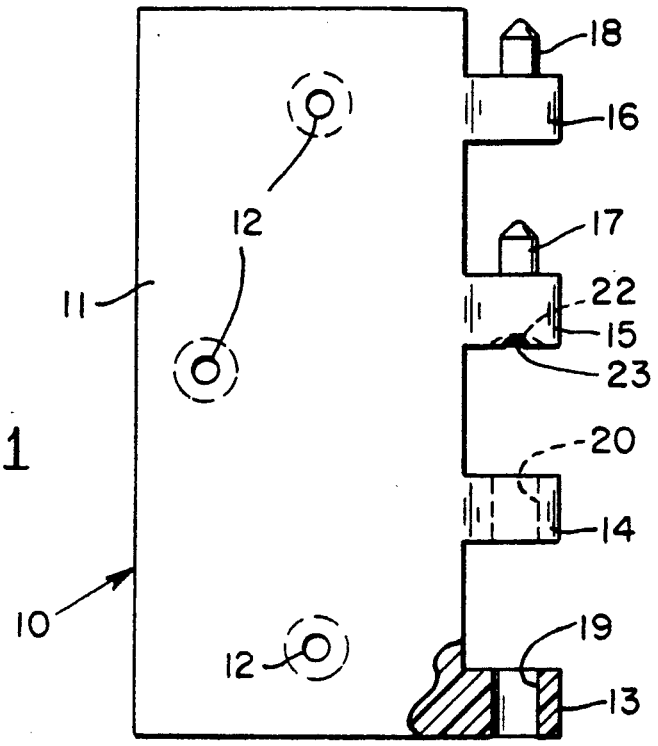
FIG. 1 is a front elevational view of a hinge plate for use in producing a hinge made according to a first embodiment of this invention.

Referring now to the drawings by numerals of reference, and first to FIG. 1, 10 denotes generally a novel hinge plate having an elongate, flat, generally rectangularly shaped mounting section or portion 11, which is used to attach plate 10 to either an immovable object, such as a door frame in a wall, or to a movable object such as the door itself. Plate 10 may be anchored to a door frame or a door by means of screws (not illustrated) passing through a plurality of countersunk screw holes 12 in section 11. Integral with and extending from one longitudinal side edge of plate 10, the right hand edge, as shown in FIG. 1, are four, spaced, coaxially aligned cylindrical barrels 13, 14, 15 and 16. Barrels 15 and 16 have projecting from their upper surfaces, identical reduced-diameter cylindrical projections 17 and 18, respectively, which extend in the same coaxial direction and taper to a point at their remote ends. Barrels 13 and 14 have therethrough identical cylindrical bores 19 and 20, respectively, which extend coaxially through each barrel, and the diameters of which bores are slightly larger than the diameters of the cylindrical projections 17 and 18, respectively.

In the embodiment illustrated, all of the barrels 13-16 are essentially of the same thickness, and the pins or projections 17 and 18 are identical. Moreover, the space between barrels 13 and 14 is equal to the space between barrels 14 and 15, and is at least equal to the overall thickness or height of each barrel 15 and 16 and its respective projection 17 and 18.

Also as shown in FIG. 1, barrel 15 has in its plane bottom surface centrally thereof a segmental spherical recess 22, diametrally opposite sides of which communicate with the inner ends of a pair of shallow, arcuate scallops or notches 23, which extend inwardly from the diametrally opposed outer bottom edges of barrel 15 for a purpose noted hereinafter.

Figure 2:
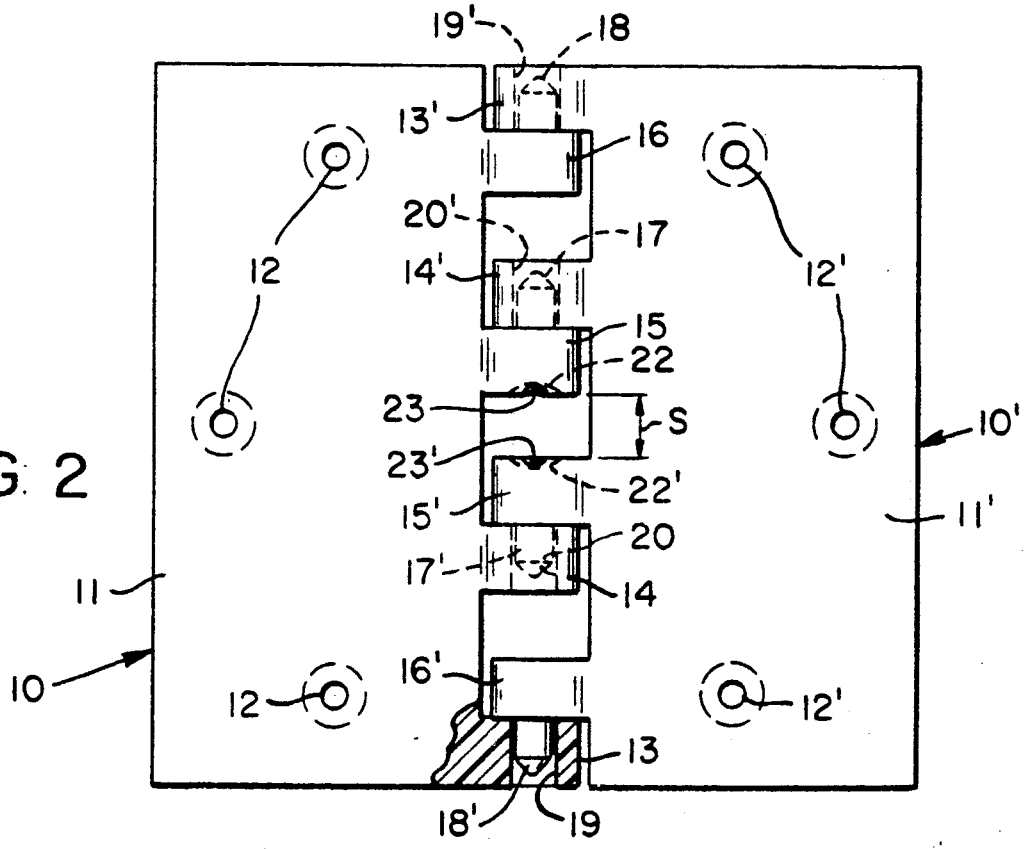
FIG. 2 is a front elevational view of two of these hinge plates as they appear after being partially assembled to form a hinge made according to this first embodiment, portions of one plate being broken away and shown in position.

Referring now to FIG. 2, 10' denotes generally a second hinge plate identical in structure to plate 10. Assembly of the illustrated hinge requires the two identical hinge plates 10 and 10' to be positioned with hinge plate 10' rotated 180° about its horizontal axis relative to plate 10, and with its bores 19' and 20' overlying projections 18 and 17, respectively, and with its cylindrical projections 18' and 17' overlying bores 19 and 20, respectively. While maintaining all the barrels in coaxial alignment, hinge plate 10' is then moved downwardly to cause cylindrical projections 17, 17', 18 and 18' to slide into and rotatably engage in corresponding bores 20', 20, 19' and 19, respectively.

To releasably secure hinge plates 10 and 10' in an operational position, a locking element, which is denoted generally by numeral 30 in FIG. 4, is inserted into the space S (FIG. 3) which exists between barrels 15 and 15' after plates 10 and 10' have been pivotally connected to each other. Element 30 is a ball-collar complex, comprising a spherical element or ball 31 which is fixed in a ring 32. Opposed, segmental spherical portions of ball 31 project from opposite sides of ring 32 and seat releasably in recesses 22 and 22' located in the confronting surfaces of barrels 15 and 15'. Insertion of the ball-collar complex 30 into recesses 22 and 22' is accomplished by aligning notches 23 and 23', which allow the ball-collar complex 30 to be forced radially inwardly into the space between barrels 15 and 15' so that ball 31 rests in recesses 22 and 22'. The hinge plates are now releasably and pivotally secured together, and vertical motion of one plate 10 or 10' relative to the other is prevented by ball 31. Also, shifting of the ball 31 is prevented by collar 25 and recesses 22, 22'.

Removal of the ball-collar complex 30 requires alignment of grooves 23 and 23', after which element 30 can be removed radially outwardly from the hinge by prying it out of recesses 22 and 22' by using a screwdriver or the like.

Referring now to the embodiment shown in FIGS. 5-5B, wherein like numerals are employed to denote elements similar to those shown in the first embodiment, 40 and 40' denote generally a pair of plates which are similar to plates 10 and 10', respectively, except for the fact that instead of having recessess 22, 23 and 22', 23' in their respective confronting surfaces, the barrels 15 and 15' have thereon at the sides thereof remote from their resepctive pins 17 and 17', reduced-diameter cylindrical projections 42 and 42', respectively, which project part way into the space S when plates 40 and 40' are pivotally connected together.

To lock plates 40 and 40' against any undesirable vertical movement relative to one another after they have been pivotally interconnected, a generally C-shaped retaining ring element 44 (FIGS. 5 and 5A) is releasably inserted into the space S. As shown more clearly in FIG. 5A, element 44 has a flexible, annular wall section 45 having in one diametral side thereof a slot 46, and having an integral grip or handle section 47 projecting from the side thereof opposite slot 46. Handle section 47 is used to force the open or slotted end of section 45 into space S so that the projections 42 and 42' snap into the bore in section 45 where the projections 42 will remain seated until element 44 is withdrawn manually by its handle section 47. Element 44 has a thickness or height approximately equal to the height of space S, whereby the element will prevent any axial shifting between plates 40 and 40'.

FIG. 5B illustrates a modified locking insert 44' which is similar to the C-shaped insert 44, except that the handle section 47' has therein a vertical hole 48 in which a hook or the like may be inserted for use in removing insert 44' from a hinge.

Referring now to the embodiment shown in FIGS. 6 and 7, and where, again, like numerals are employed to denote elements similar to those disclosed in the preceding embodiments, numerals 50 and 50' denote hinge plates similar to plates 10 and 10', respectively, except that the projections on barrels 15 and 15' are shaped differently than projections 17 and 17', and for that reason the bores 20 and 20' in barrels 14 and 14' likewise are different in shape than those in the preceding embodiments.

More specifically, barrels 15 and 15' of plates 50 and 50' have thereon projections 52 and 52', respectively, which perform the dual function of connecting plates 50 and 50' together for relative pivotal movement about a common hinge axis, and to prevent any undesirable shifting of one plate relative to the other along the hinge axis. For this purpose, each projection 52 and 52' comprises a cylindrical base section 53, 53', respectively, an enlarged diameter head section 54, 54' respectively, and an elongate, axially extending slit 55, 55', respectively, which extends diametrally through the head and base sections of each projection 52 and 52', thereby dividing each such projection into two, spaced, flexible sectors which are generally semi-cylindrical in cross section.

To accomodate the flexible projections 52 and 52', the bores in the confronting barrels 14 and 14' of a hinge have compound shaped bores the inlet ends of which (the ends 56, 56' into which projections 52, 52' are inserted during assembly) have diameters approximately equal to but slightly larger than the diameters of the base sections 53, 53' of projections 52 52', and the outlet ends 57, 57' of which have diameters corresponding to but slightly larger than the head sections 54, 54' of the projections 52, 52'.

Figure 6:
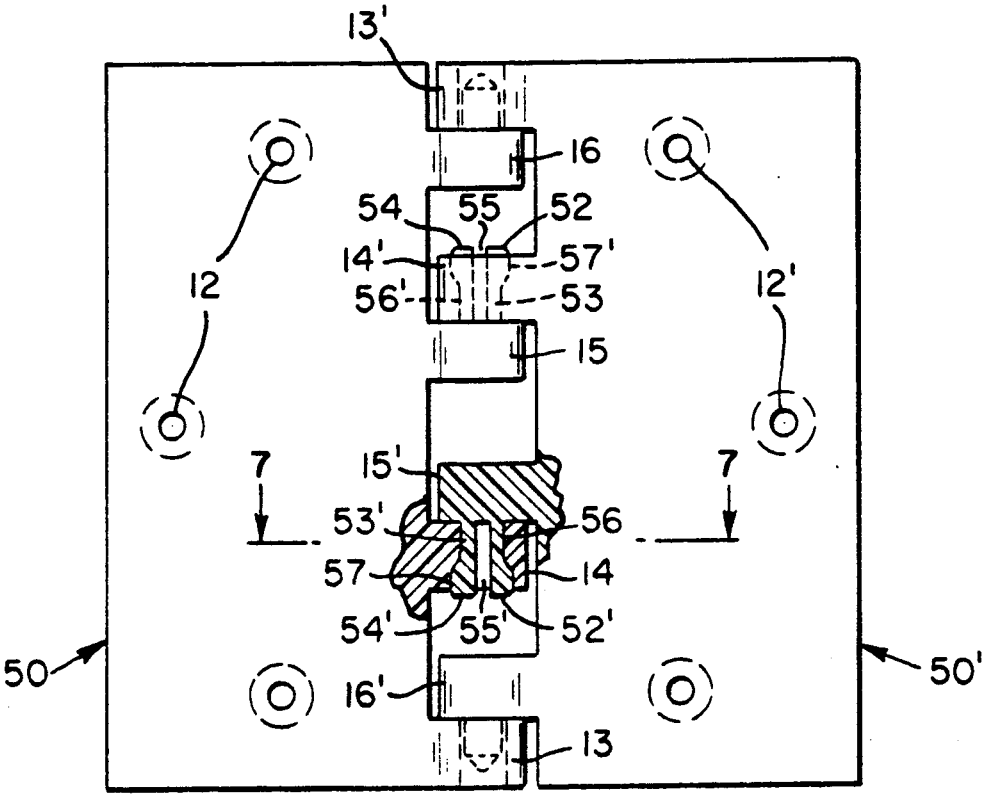
FIG. 6 is a frontal elevational view of a hinge made in accordance with a third embodiment of this invention, portions thereof being broken away and shown insection.
Figure 7:
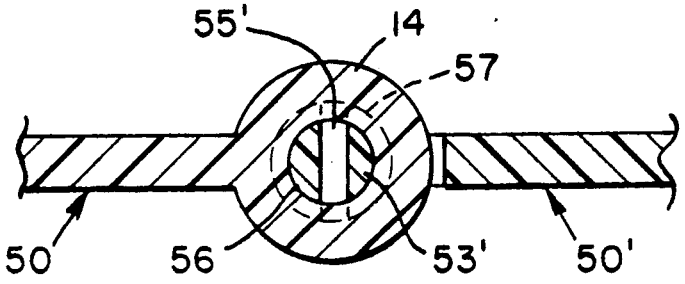
FIG. 7 is a sectional view taken generally along the line 7—7 in FIG. 6 looking in the direction of the arrows.

As noted more clearly in FIG. 6, each of the head sections 54 and 54' at opposite ends thereof has beveled edges, which aid in the insertion and removal of the head sections to and from the bores in the barrels 14 and 14'. For example, when the plates 50 and 50' are assembled, at which time barrel 14' will overlie the upper end of the projection 52 and projection 52' will overlie the upper end of the bore in barrel 14, the plates are assembled in the usual manner by urging plate 50' downwardly relative to plate 50. This will cause the beveled upper end of projection 52 to engage in the inlet end 56' of the bore in barrel 14', at the same time that the beveled lower end of the head section of projection 52' will become engaged in the inlet end 56 of the bore in barrel 14. As a plate 50' is urged downwardly relative to plate 50, the flexible sections of the projections 52 and 52' will flex inwardly far enough to permit the respective heads 54 and 54' to be inserted into the bores in the barrel 14' and 14, respectively. When the projections 52 and 52' become fully seated in the bores in the barrels 14' and 14 the head sections of the projections will expand slightly, fully and flexibly to seat in the enlarged-diameter ends 57' and 57 of the bores in the barrels 14' and 14, respectively. The projections 52 and 52' thus not only permit pivotal movement of the plates 50 and 50' relative to each other about the axial center line of the registering barrels, but also, because of the enlarged-diameter head sections 54 and 54', prevent any undesirable axial shifting of one plate relative to the other.

From the foregoing it will be apparent that the present invention provides relatively simple and inexpensive means for producing improved hinge mechanisms, which are extremely simple to assemble and disassemble, and which obviate the need for employing separate, conventional hinge pins. A primary advantage of this construction is that each of the two plates for a given hinge can be made identically, and at least in the case of the embodiment shown in FIGS. 6 and 7, do not require any separate locking means for retaining the two plates in their operative hinge-forming positions. Even in the case of the first and second embodiments, the locking elements, which are of course optional, are extremely inexpensive to manufacture and to insert or remove from an associated hinge, thus making the corresponding hinges particularly suited for use in a variety of different situations, for example from conventional heavy doors or small cabinet covers, etc.

Even more importantly, it is possible to make the above-described plates and associated locking elements out of plastic materials which can be injection molded or the like, so that the need for utilizing metallic elements can be eliminated, thus reducing the overall weight of the resulting hinges and eliminating many machining operations heretofore required for producing metal hinges and the like. By utilizing a slightly flexible or resilient material, the ball element 31 can be designed to be slightly compressible, thereby to enable it to fit snugly and releasably in the space between barrels 15 and 15'. Also, while the hinge plates disclosed herein are shown to have four barrels each, it will be apparent that the number of barrels per plate can be altered without departing from this invention.

Although this invention has been illustrated and described in connection with only certain embodiments thereof, it will be apparent that it is capable of still further modification, and that this application is intended to cover any such modifications as may fall within the scope of one skilled in the art, or the appended claims.

I claim:

1. A hinge, comprising a pair of identical hinge plates each of which has thereon a longitudinal side edge, a plurality of spaced, parallel, longitudinally registering barrels projecting from said longitudinal side edge of each plate, at least one of said barrels on each of said plates having therein an axial bore disposed coaxially of an axis extending parallel to the longitudinal side edge of the associated hinge plate, and at least one other of said barrels on each of said plates having thereon a cylindrical pin projecting coaxially from one side thereof, the barels of one of said plates being disposed in overlapping coaxial relation with the barrels of the outer of said plates, said cylindrical pin on said at least one other of said barrels on said one plate projecting coaxially and pivotally into the bore in said at least one of said barrels in said other plate, the two barrels of an adjacent pair of said overlapping barrels having thereon confronting surfaces disposed in axially spaced confronting relation to each other, and separated locking means removably secured in the space between said confronting barrels and releasably engaged with said confronting surfaces thereby to prevent the barrels of said one plate from shifting axially relative to the barrels of said other plate during operation of the hinge.

2. A hinge as defined in claim 1, wherein the distance between adjacent barrels on each of said plates is equal at least to the sum of the axial thickness of said at least one of said other barrels and the axial length of the cylindrical pin projecting therefrom.

3. A hinge as defined in claim 2, wherein the barrels on each of said plates are of equal axial thickness, and each of said cylindrical pins has an axial length slightly less than one half said distance between adjacent barrels.

4. A hinge, comprising a pair of identical hinge plates each of which has thereon a longitudinal side edge, a plurality of spaced, parallel, longitudinally registering barrels projecting from said longitudinal side edge of each plate, at least one of said barrels on each of said plates having therein an axial bore disposed coaxially of of an axis extending parallel to the longitudinal side edge of the associated hinge plate, at least one other of said barrels on each of said plates having thereon a cylindrical pin projecting coaxially from one side thereof, the barrels of one of said plates being disposed in overlapping coaxial relation with the barrels of the other of said plates, said cylindrical pin on said at least one other of said barrels on said one plate projecting coaxially and pivotally into the bore in said at least one of said barrels in said other plate, the two barrels of an adjacent pair of said overlapping barrels being disposed in axially spaced confronting relation to each other, and locking means removably secured in the space between said confronting barrels and operative to prevent the barrels of said one plate from shifting axially relative to the barrels of said other plate during operation of the hinge, said locking means comprising a locking element removably disposed in said space between said confronting barrels, and said element having thereon opposed, generally segmental spherical surfaces seated removably in mating segmental spherical recesses formed in the confronting surfaces of said confronting barrels coaxially thereof.

5. A hinge as defined in claim 4, wherein said locking element comprises a spherically shaped ball secured coaxially in, and projecting axially from opposite ends of, an annular collar having an outside diameter less than the outside diameter of each of said barrels.

6. A hinge, comprising a pair of identical hinge plates each of which has thereon a longitudinal side edge, a plurality of spaced, parallel, longitudinally registering barrels projecting from said longitudinal side edge of each plate, at least one of said barrels on each of said plates having therein an axial bore disposed coaxially of an axis extending parallel to the longitudinal side edge of the associated hinge plate, at least one other of said barrels on each of said plates having thereon a cylindrical pin projecting coaxially from one side thereof, the barrels of one of said plates being disposed in overlapping coaxial relation with the barrels of the other of said plates, said cylindrical pin on said at least one other of said barrels on said one plate projecting coaxially and pivotally into the bore in said at least one of said barrels in said other plate, the two barrels of an adjacent pair of said overlapping barrels being disposed in axially spaced confronting relation to each other, and locking means removably secured in the space between said confronting barrels and operative to prevent the barrels of said one plate from shifting axially relative to barrels of said other plate during operation of the hinge, said locking means comprising a generally C-shaped element comprising a flexible, slotted, annular wall section having a radial slot in one dimetral side thereof, and having an integral handle section projecting radially from its outer periphery at its diametrally opposite side, said slotted, annular wall section of said C-shaped element being removably and coaxially positioned in said space between said confronting barrels with said handle section projecting radially outwardly from said space, and the confronting surfaces of said confronting barrels having thereon circular projections which extend coaxially and snugly into opposite ends of the bore in said annular wall section of said C-shaped element.

7. A hinge as defined in claim 6, wherein said handle section has therein an axial bore radially spaced from and extending parallel to the bore in said annular wall section of said C-shaped element.

8. A hinge comprising a pair of identical hinge plates each of which has thereon a longitudinal side edge, a plurality of spaced, parallel, longitudinally registering barrels projecting from said longitudinal side edge of each plate, at least one of said barrels on each of said plates having therein an axial bore disposed coaxially of an axis extending parallel to the longitudinal side edge of the associated hinge plate, at least one other of said barrels on each of said plates having thereon a cylindrical pin projecting coaxially from one side thereof, the barrels of one of said plates being disposed in overlapping coaxial relation with the barrels of the other of said plates, said cylindrical pin on said at least one other of said barrels on said one plate projecting coaxially and pivotally into the bore in said at least one of said barrels in said other plate, said cylindrical pin on said at least one other of said barrels on each of said plates having thereon an enlarged-diameter head section axially spaced from said one side of its associated barrel, and having therethrough a diametral slot which permits limited radial compression of aid head section, and the barrel bore into which said one cylindrical pin projects having in the end thereof opposite the end into which said pin projects, an enlarged-diameter recess similar in configuration to said enlarged-diameter head section of said one pin.

9. A hinge as defined in claim 8, wherein said one cylindrical pin has an axial length slightly greater than the axial length of the barrel bore into which it projects, whereby said enlarged-diameter head section of said one pin projects axially slightly beyond said opposite end of said barrel bore 10. A hinge plate comprising a flat plate having at least one longitudinal side edge, a plurality of spaced, parallel, cylindrical barrels integral adjacent one diametral side with said longitudinal side edge of said plate, and projecting from said side edge in spaced, coaxial, registering relation, one of said barrels having therethrough an axial bore extending parallel to said longitudinal side edge of said plate, another of said barrels adjacent said one barrel having cylindrical projections extending coaxially from opposite ends thereof, one of said projections having an axial length greater than the other of said projection, and said other projection confronting upon said one barrel.

11. A hinge plate, comprising a flat plate having at least one longitudinal side edge, a plurality of spaced, parallel, cylindrical barrels integral adjacent one diametral side with said longitudinal side edge of said plate, and projecting from said edge in spaced, coaxial, registering relation, one of said barrels having therethrough an axial bore, and another of said barrels adjacent said one barrel having thereon a generally cylindrical projecting extending coaxially from the end thereof remote from said one barrel, said projection having an axial length slightly greater than the axial length of the axial bore in said one barrel, and having therein an axially extending slot causing at least a portion of said projection to be radially compressible, said projection having thereon an enlarged diameter head section through which said slot extend diametrally, and said one barrel having in the end of its axial bore remote from said other barrel an enlarged-diameter recess similar in configuration to said enlarge-diameter head section of said projection.

* * * * *